United States Patent [19]

Specktor

[11] 4,151,737

[45] May 1, 1979

[54] APPARATUS FOR REPAIRING AND STRAIGHTENING

[76] Inventor: Gerald A. Specktor, 409 Cleveland Ave. S., St. Paul, Minn. 55105

[21] Appl. No.: 496,848

[22] Filed: Aug. 12, 1974

[51] Int. Cl.[2] ..... B21D 1/14

[52] U.S. Cl. ..... 72/457; 72/705

[58] Field of Search ..... 72/705, 457

[56] References Cited

U.S. PATENT DOCUMENTS

| | | | |
|---|---|---|---|
| 2,013,785 | 9/1935 | Merrill | 72/705 |
| 2,219,191 | 10/1940 | Merrill et al. | 72/705 X |
| 2,563,527 | 8/1951 | Gingrich et al. | 72/705 |
| 2,692,002 | 10/1954 | Merrill | 72/705 |
| 2,717,020 | 9/1955 | Dobias | 72/705 X |
| 3,257,838 | 6/1966 | Spears | 72/705 |
| 3,269,169 | 8/1966 | Latuff et al. | 72/705 X |
| 3,340,720 | 9/1967 | Chartier | 72/705 X |
| 3,377,834 | 4/1968 | Latuff et al. | 72/705 X |
| 3,626,747 | 12/1971 | Rouis | 72/705 X |
| 3,630,066 | 12/1971 | Chisum | 72/705 X |
| 3,754,432 | 8/1973 | Hagerty | 72/705 X |
| 3,776,022 | 12/1973 | Lionello | 72/705 X |
| 3,777,541 | 12/1973 | Whitney | 72/705 X |
| 3,798,956 | 3/1974 | Kopczynski | 72/422 X |
| 3,835,693 | 9/1974 | Majersky | 72/705 X |
| 3,888,100 | 6/1975 | Chisum | 72/705 X |

FOREIGN PATENT DOCUMENTS

| | | | |
|---|---|---|---|
| 2038362 | 2/1972 | Fed. Rep. of Germany | 72/705 |
| 1011759 | 12/1965 | United Kingdom | 72/705 |

*Primary Examiner*—C. W. Lanham
*Assistant Examiner*—D. M. Gurley
*Attorney, Agent, or Firm*—Wicks & Nemer

[57] ABSTRACT

Apparatus for repairing and straightening is disclosed in its preferred form for use in repairing and straightening the body and frame of a vehicle. The preferred apparatus includes a tread member including left and right track members for supporting a vehicle thereon, a tram member movable along and between the right and left track members and including two elongatable pull towers pivotally mounted thereto, and an additional elongatable pull tower mounted adjacent an end of the apparatus. A flexible connector, preferably a chain, is arranged for connection between the pull towers and the vehicle. The track members further include regularly shaped apertures which vertically pass therethrough. Locking pins are also provided which extend through an aperture of the track members and abut with a portion of the pull towers to lock the pull towers at any desired angle to the tread member. Bolsters are further provided which extend through the regular apertures of the track member and abut with a portion of the vehicle frame for anchoring the vehicle to the apparatus to prevent the vehicle from moving when it is subjected to the counter forces during the repair and straightening operation.

56 Claims, 15 Drawing Figures

APPARATUS FOR REPAIRING AND STRAIGHTENING

BACKGROUND

This invention relates generally to a repair and straightening apparatus and more particularly, in the preferred embodiment, to apparatus for repairing and straightening vehicle bodies and frames.

In the field of vehicle frame and body repairing and straightening, various types of apparatus are currently available. Several types of apparatus currently known to be available present serious limitations and deficiencies regarding the ability of repair personnel to work on both the front and rear ends of a vehicle. Presently, whenever it is necessary to work on both the front and rear ends of a vehicle, it is necessary for the vehicle to be turned in these apparatus to expose the damaged portions of the vehicle to the repair members of the apparatus. It is thus immediately obvious that such a cycle of repair-turn-around-repair is time consuming and thus of great expense to both the repair operator and the owner of the vehicle.

Further, types of apparatus presently known to be available which do repair a vehicle around its entire 360 degree periphery are complicated and expensive. For example, one such apparatus requires a working pit and the use of complicated structure for the positioning of the pulling members.

Therefore, there is a definite need in the art for a vehicle body and frame straightening and repairing device which allows several repair operations to be performed on a vehicle, including the repair of both the front and rear portions, without the necessity of removing the vehicle from the device, turning it around, and remounting it on the device.

There is also a definite need in the art for a vehicle body and frame straightening and repairing device which is flexible such that the repair force can be applied in a direction parallel to the direction of the force that caused the damage. Further the apparatus should be of a simple design, efficient, and easy to operate to reduce the amount of time and labor required for the repair of damages and to maximize the equipment and materials used.

SUMMARY

The present invention solves these and other problems in vehicle repair and straightening by providing, in the preferred embodiment, an apparatus for repairing and straightening the body and frame of a wheeled vehicle including a tread member, for the support of the vehicle thereon, having regularly shaped apertures therethrough. The apparatus further has the ability to apply a pulling force at any position 360 degrees around the vehicle.

In the preferred embodiment, a tram, movable along and between the right and left tracks of the tread member and including pulling members pivotally mounted thereto, is used to apply the pulling force to any position 360 degrees around the vehicle.

Pull tower locking pins are further provided for use in locking the pull towers at any angle with respect to the tread member. The locking pins include a body portion which substantially fills an aperture of the tread member and a portion which abuts with a portion of the pull towers.

Vehicle securing members in the form of bolsters are further provided. The bolsters include a body portion which substantially fills an aperture of the tread member and an abutting portion which interacts with the vehicle frame. A locking ring is used to hold the bolster within the aperture of the tread member adjacent the vehicle.

Therefore, it is a primary object of this invention to provide a novel repair and straightening apparatus.

It is also an object of this invention to provide a novel repair and straightening apparatus for vehicles.

It is also an object of this invention to provide a novel repair and straightening apparatus for repairing a vehicle around its entire 360 degree periphery.

It is also an object of this invention to provide a novel repair and straightening apparatus of simple design which is flexible to allow the repair force to be applied at any desired angle corresponding to the direction of the damaging force.

It is also an object of this invention to provide a novel repair and straightening apparatus which maximizes the equipment and materials used.

It is also an object of this invention to provide a novel apparatus which repairs and straightens frames and bodies of vehicles in an efficient manner.

It is also an object of this invention to provide a novel repair and straightening apparatus with means for allowing easy and quick locking of the pull towers at a desired angle about the item to be repaired.

It is also an object of this invention to provide novel repair and straightening apparatus with means for allowing the easy and rapid securing of a vehicle onto the apparatus.

It is yet another object of this invention to provide a novel repair and straightening apparatus with means for maximizing the pulling force applied to a damaged vehicle.

These and further objects and advantages of the present invention will become clearer in the light of the following detailed description of an illustrative embodiment of this invention described in connection with the drawings.

DESCRIPTION OF THE DRAWINGS

The illustrative embodiment may best be described by reference to the accompanying drawings where:

FIG. 3 is a top view of the apparatus of FIG. 1.

Figures 1, 4, 7:
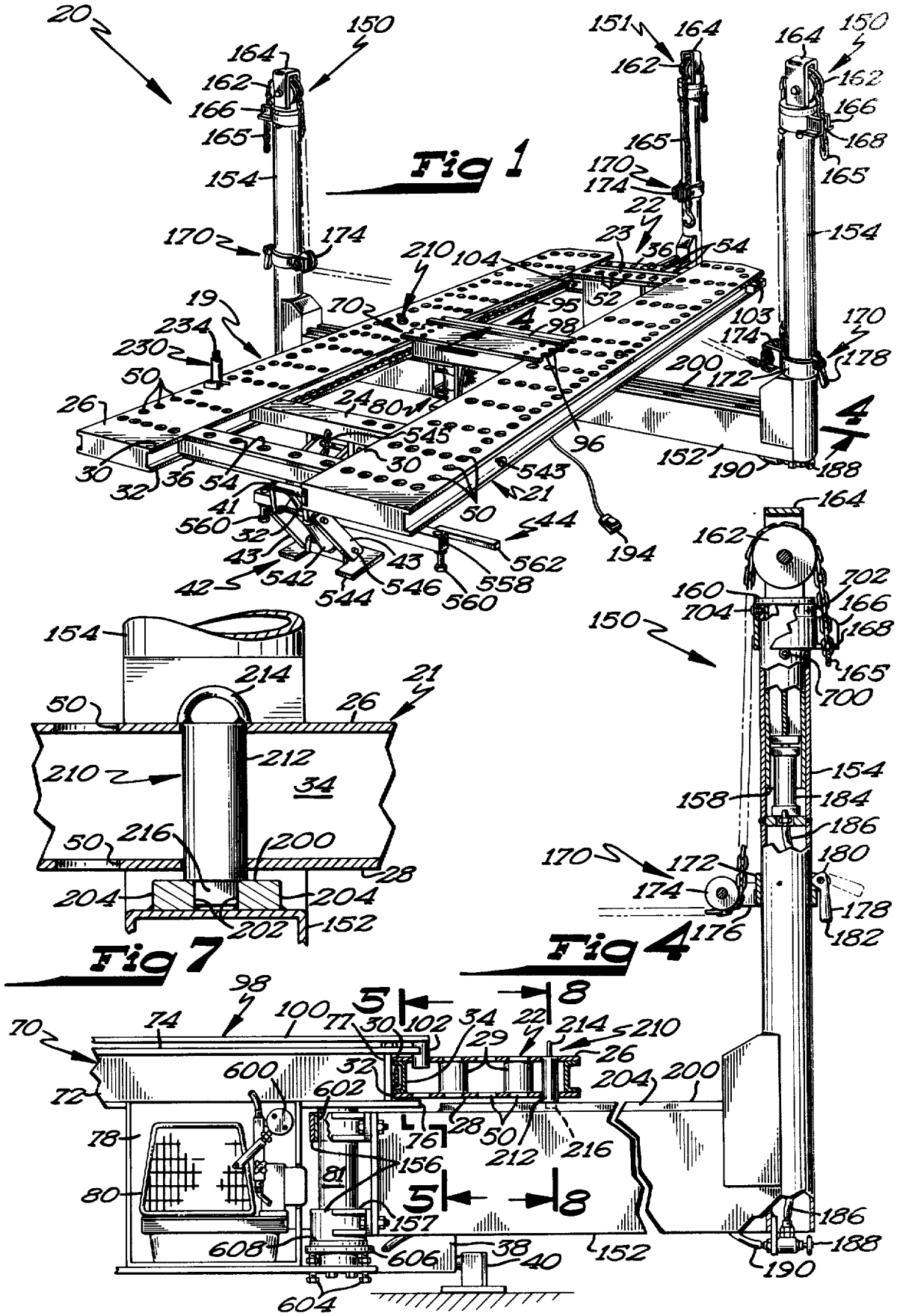
FIG. 1 is a perspective view of an apparatus for repairing and straightening the body and frame of a vehicle according to the teachings of the present invention.
FIG. 4 is a partial sectional view taken along section line 4—4 in FIG. 1.
FIG. 7 is a partial sectional view taken along section line 7—7 in FIG. 3.

Where used in the various figures of the drawings, the same numerals designate the same or similar parts. Furthermore, when the terms "right," "left," "front," "back," "vertical," "horizontal," "right end," "left end," "inside," "rear," "bottommost," and similar terms are used herein, it should be understood that these terms have reference only to the structure shown in the drawings as it would appear to a person viewing the drawings and are utilized only to facilitate describing the invention.

DESCRIPTION

Referring to the drawings, preferred apparatus for repairing and straightening the body and frame of a vehicle is shown and generally indicated as 20. The straightening apparatus 20 includes a tread member, generally designated 22, having left and right tracks, 19 and 21, respectively, held in a spaced relation by front and rear cross members, 23 and 24 respectively, such that the tires of a vehicle placed thereon are supported by tread member 22. Each track 19 and 21 includes a tread top surface 26 having an inside top flange 30, a tread bottom surface 28 having an inside bottom flange 32, reinforcing members 29 which hold the top surface 26 and the bottom surface 28 in a spaced relation, and an inside side wall 34 spaced inwardly from the ends of the flanges 30 and 32. Flanges 30 and 32 and inside side wall 34 form a C-shaped track on the inside surface of each track 19 and 21 of the member 22. Removable cross ties 36 can be positioned such that the ends extend within the C-shaped tracks formed by flanges 30 and 32 of the left and right tracks 19 and 21, respectively, in tread member 22.

Connected to cross member 23 is a support member 38 having a lower pivot member 40 such that tread member 22 can be pivoted from a horizontal position to an angularly offset position as shown in phantom in FIG. 2 to allow placement of a vehicle on tread member 22, as will be explained hereinafter.

Suitable lift scissors 42 can be provided to raise and lower one end of tread member 22 to allow placement of the vehicle upon tread member 22. Lift scissors 42 include connector arms 41 and 43, floor pivot 544, pivot pins 546, 548, 550, and 552, and hydraulic jack 542 controlled by valve 543 connected to hose 545 such that when jack 542 is caused to extend, lift scissors 42 expands thus raising the one end of tread member 22 from an angular position to a horizontal position.

A safety leg 44 can be provided to prevent accidental tilting of the tread member 22 from the horizontal position. Safety leg 44 includes support members 554 connected to a horizontal member 558 having adjustable legs 560. Support members 554 are pivotally mounted as at 556. Safety leg 44 can be pivoted to a horizontal position adjacent to tread member 22 when tread member 22 is desired to be placed in an angularly offset position, and can be pivoted to the vertical position shown in FIG. 2 when tread member 22 is desired to be held in a horizontal position. As best seen in FIG. 1, an extension 562 can be provided so that safety leg 44 can be readily pivoted by an operator.

Triangular floor members 46, having top surfaces 48, are shown as positioned on the floor such that when tread member 22 is angularly offset, top surface 26 is flush with top surfaces 48 of triangular floor members 46. In such a position one end of tread member 22 is touching the floor and tread top surface 26 and top surface 48 of floor members 46 form a smooth incline to allow a car to be driven or winched onto tread member 22.

A multitude of regularly shaped apertures 50, such as circular apertures as shown, are formed in track members 19 and 21 of tread member 22 such that apertures 50 extend vertically through tread top surface 26 and bottom surface 28 in a substantially vertically aligned manner. Apertures 52 and 54 are shown as formed in removable cross ties 36 and cross members 23 and 24, respectively, in a similar manner.

A tram, generally designated 70, is movably mounted along and between the right and left track members 19 and 21 of tread member 22. As best seen in FIG. 4, tram 70 includes a tram carrier member 72, a hydraulic unit cavity 78, and pivot members 81. Tram carrier member 72 includes a tram top 74 that extends over top flange 30 of tread member 22 and a tram bottom 76 that extends over the bottom flange 32 of each tread member 22. Tram top 74 and bottom 76 are more widely spaced than tread top surface 26 and bottom surface 28 such that flanges 30 and 32 are positioned within tram carrier member 72. A tram side wall 77 is spaced from the ends of top 74 and bottom 76 and runs parallel to the track members 19 and 21 of tread member 22. A tram hydraulic unit, generally designated 80, is positioned within tram hydraulic unit cavity 78. An auxilliary jack, not shown, can further be stored in a container 600 when not in use.

Figures 2, 5, 6, 8, 9:
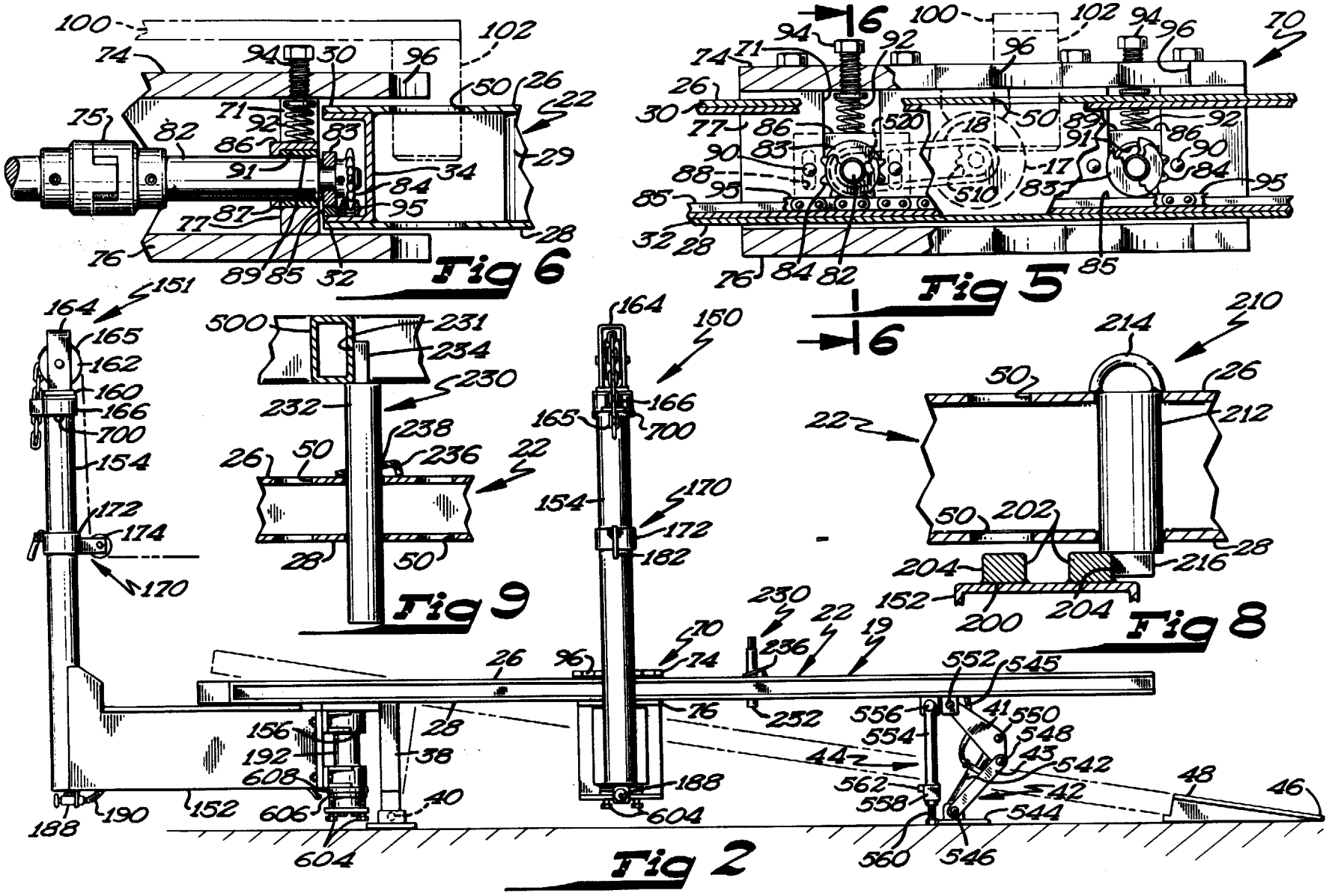
FIG. 2 is a side elevation view of the apparatus of FIG. 1.
FIG. 5 is a sectional view taken along section line 5—5 in FIG. 4.
FIG. 6 is a partial sectional view taken along section line 6—6 in FIG. 5.
FIG. 8 is a partial sectional view taken along section line 8—8 in FIG. 4.
FIG. 9 is a partial sectional view taken along section line 9—9 in FIG. 3.

As best seen in FIGS. 5 and 6, a pair of shafts 82 carrying sprockets 84 extend from both ends of tram carrier member 72 through a U-shaped aperture 71 formed in side wall 77 into the C-shaped tracks formed by flanges 30 and 32 in the right and left tracks of tread member 22. Each of the pair of shafts 82 include a flexible connector 75 that allow shafts 82 to flex adjacent their centers. Wheel bearing retainers 86 include a flat plate 87 having vertical slots 88, an inverted U-shaped removed portion 91, formed therein, and a shaft hold down member 89 formed at the closed portion of removed portion 91. Retainers 86 are slidably mounted to the inside surface of side wall 77 by projections 90, such as bolts, which extend through vertical slots 88 of retainers 86. Therefore, retainers 86 are allowed to move in a vertical direction. Retainers 86 are biased downwardly by the use of a spring 92. The tension of spring 92 can be varied by rotating bolt 94.

In the assembled relation, shaft 82 is captured within the U-shaped aperture 71 of side wall 77 by the shaft hold down member 89 of the retainer 86. Therefore, shafts 82 are resiliently mounted within tram carrier member 72. One or both of shafts 82 can be driven by the use of an electric motor 17 carried by the tram top 74 which drives a roller chain 18 in a conventional manner by sprockets 510 and 520 located on motor 17 and shaft 82, respectively, as is shown in FIG. 3 and as shown in phantom in FIG. 5.

Under no load, spring 92 biases retainers 86 downwardly such that tram carrier 72 is positioned such that tram top 74 is vertically spaced above tread member top surface 26 and tram bottom 76 is vertically spaced below tread bottom surface 28. The spacing of tread member 22 within tram carrier 72 can be varied by the adjustment of the tension of spring 92 by rotating bolt 94. But, if tram 70 is placed under a load such as that from a counter force of the pulling force exerted on a damaged vehicle, as will be explained further hereinafter, the springs 92 are compressed thereby flexing shafts 82 through connectors 75 such that tram top 74 contacts tread top surface 26 and/or tram bottom 76 contacts tread bottom surface 28. Thereby, when a load is placed on tram 70, the stress is placed on tram top 74 and/or tram bottom 76 of tram carrier member 72 rather than shafts 82. Thus, shafts 82 have to be of sufficient size to move tram 70 and to withstand the force required to compress springs 92, but not to withstand the major forces exerted on tram 70 and thus shafts 82 are not required to be of excessive size.

Stationary, elongated gear members 95, such as chain links fastened to bottom flanges 32 of the C-shaped tracks adjacent side walls 34 of track members 19 and 21 of tread member 22, engage sprockets 84 of tram 70 thus forming a rack and pinion gear assembly. Rail portions 85 are formed in the C-shaped tracks formed by flanges 30 and 32 adjacent chain links 95 to accommodate chain links 95. Motor 17 drives at least one of the shafts 82 through roller chain 18 such that sprocket 84 meshes with stationary chain links 95 and thus moves tram 70. To reduce the amount of weight carried by sprocket 84, shaft 82 can additionally include a roller 83 preferably formed of steel that rides on rail portion 85 formed on the bottom surface of the C-shaped tracks parallel to chain links 95. Further, roller 83 allows the smooth movement of tram 70 within tread member 22 rather than a bouncing movement that would be caused by the teeth of sprockets 84 falling into and thereby riding on chain links 95. Chain links 95 could optionally be placed on top flange 30 to avoid the collection of foreign material within chain links 95.

A switch 103 is mounted on the side of tread member 22 to control tram motor 17 turning shaft 82 and thus the movement of tram 70. Limit switches 104 located on cross members 23 and 24 stop tram 70 when contacted to prevent tram 70 from ramming cross members 23 and 24.

As best seen in FIG. 4, a locking member 98 secures tram 70 in a stationary position. Locking member 98 includes an elongated member 100 which is placed parallel to tram top 74 and vertical projections 102, having a regular shape corresponding to apertures 50, located adjacent the ends of elongated member 100 that interfit with removed portions 96 formed on tram top 74. To lock tram 70, locking member 98 is positioned such that projections 102 extend vertically into removed portions 96 and into apertures 50 formed within tread member 22 to securely hold tram 70 in a stationary position. When it is desired to move tram 70, locking member 98 is raised from the straightening device 20 such that projections 102 do not extend into apertures 50 of tread member 22. After moving tram 70 to the desired position, locking member 98 may again be positioned such that projections 102 again extend through removed portions 96 into apertures 50 of tread member 22.

To provide a pulling force to vehicles placed on the straightening apparatus 20, pull towers 150 and 151 are provided which are pivotally interconnected to the tread member 22. Pull towers 150 include a connector arm 152 and a hollow cylindrical, stationary, vertical portion 154. Clamps 156 and gussets 157 are connected to connector arm 152 to pivotally mount pull towers 150 on pivot members 81. In the preferred embodiment, clamps 156 include nylon bushings 602 forming a ring sleeve type bearing such that clamps 156 are able to convey to pivot 81 a force from any direction applied to connector arm 152. Connector arm 152 is vertically positioned on pivots 81 by adjustment screws 604 which abut a steel thrust plate 606. To reduce the amount of friction between clamps 156 and plate 606, a nylon plate bearing 608 can further be provided to allow towers 150 to be easily pivoted about pivots 81.

A ram sleeve 158 having an enlarged top 160 and a pulley 162, rotatably mounted in a U-shaped member 164, is slidably mounted within vertical portion 154. Ram sleeve 158 can further be pivoted within vertical portion 154 to allow changing the direction of pulley 162. A suitable flexible pulling member 165, such as a chain, extends over pulley 162 and is secured to vertical portion 154 by a locking member 166. Locking member 166 is carried by bolts 700 beneath a collar 702 attached to vertical portion 154 by suitable bolts 704 to rotatably mount locking member 166 about vertical portion 154 and includes a slot 168 that allows insertion of the chain 165 into the slot horizontally but prevents movement of the chain 165 vertically. The chain 165 is further directed towards the vehicle to be repaired by a pulley 174 rotatably mounted in a U-shaped member 176 formed on a collar 172. Collar 172 is locked in any desired position on vertical portion 154 by a cam member 178 pivotally mounted thereon.

Cam member 178 includes a cam portion 180 and a lever arm 182 such that lever arm 182 can be pivoted to engage cam portion 180 against the side walls of vertical portion 154. Collar 172 can be slid vertically along the vertical portion 154 and rotated thereon such that chain 165 can be directed from any vertical position and from any angle on vertical portion 154. This allows the pulling force to be selectively directed to a damaged vehicle along the same line of force that initially caused the damage to the car. It should be noted that if collar 172 is pivoted about vertical portion 154 through a large angle, it may be necessary to change the direction of pulley 152 by pivoting ram sleeve 158 within vertical portion 154 and change the direction of locking member 166 by pivoting it on vertical portion 154.

Although, in the preferred embodiment, cam member 178 is used to lock collar 172 on vertical portion 154, several other methods can also be used. For example, a bolt threadably mounted to collar 172 for abutment against vertical portion 154 has also been used successfully.

A hydraulic cylinder 184 raises the ram sleeve 158 to elongate pull tower 150. Hydraulic lines 186, such as a hose, connect hydraulic cylinder 184 to valve 188 that controls the oil flow rate into cylinder 184 from hydraulic unit 80 through the hydraulic line 190 such as a hose, as shown. The rate at which cylinder 184 rises is directly related to the oil flow rate through valve 188.

An alternate method of the attachment of valve 188 to vertical portion 154 is to notch the lowermost portion of vertical portion 154 such that valve 188 is placed within vertical portion 154 such that it is above the bottom surface of connector arm 152. In such a position, hose 190 can be placed entirely within connector arm 152. Further, a horizontal ledge can be added above the valve handle to protect valve 188 from being hit and to act as a step for the operator to stand on during operation of the apparatus, i.e., positioning collar 172 on vertical portion 154, attaching chain 165 to locking member 166, or similar operations.

Since chain 165 is anchored to the stationary vertical portion 154, the free end of chain 165 travels a distance equal to twice the distance traveled by ram sleeve 158. It is known in the art to fasten chain 165 directly to ram sleeve 158, but it has been found by the present invention to be advantageous to secure chain 165 to the stationary vertical portion 154 rather than ram sleeve 158. The present invention has the advantage of being able to pull chain 165 twice as far for the same sleeve displacement and further gains a mechanical advantage in that the hydraulic cylinder 184 moves only one-half the distance it would move if chain 165 was attached directly to ram sleeve 158.

Additionally, in the arrangement of the present invention, the amount of friction between vertical portion 154 and ram sleeve 158 is greatly reduced. When a chain is attached directly to the ram sleeve, such as in devices known in the art, the sleeve cants within the vertical portion of such pulling members when such pull towers exert a pulling force on the chain. This binding of the sleeve within the vertical portion results in a large power loss at least from the large amount of friction between the outer surface of the ram sleeve and of the inner surface of the vertical portion of the pulling members thereby greatly reducing the amount of pulling force which can be applied to the vehicle.

The present invention thus has the advantage of directing the counter force of ram sleeve 158 vertically downward by the use of pulley 162. Thus ram sleeve 158 does not cant or bind within vertical portion 154. This greatly reduces the amount of friction which was previously encountered in the prior art and allows the use of smaller hydraulic cylinder 184 within pull towers 150 and 151 or the application of a larger working force to the chain 165, if the same size hydraulic cylinder is used.

Further, when the chain is directly attached to the ram sleeve, as in some prior devices, the ram sleeve cants in the vertical portion thereby applying a large amount of stress on the circumference of the vertical portion, especially at the uppermost portion of the vertical portion. To prevent damage to the vertical portion, it is necessary to lengthen the ram sleeve to insure that a minimum length of the ram sleeve is located within the vertical portion at all times.

In the present invention, however, the preferred embodiment greatly reduces this minimum length requirement by the use of pulley 162 which directs the counter force vertically downward such that ram sleeve 158 does not cant within vertical portion 154 thereby maximizing the use of the materials used.

A similar pull tower 151 can be mounted on a stationary pivot 192 that is separate and distinct from support 38. Thus, in the preferred embodiment pull tower 151, which as shown, is the same design as pull towers 150 located on tram 70, is pivotally mounted about the end and front sides of straightening apparatus 20, as shown in the figures.

A suitable control box 194 is provided to individually or collectively operate pull towers 150 and 151 located on the straightening apparatus 20.

To lock the pull towers in a desired position, suitable locking members are provided. As best seen in FIGS. 7 and 8, a raised channel 200 is formed on connecting arms 152 and includes U-shaped inside surface 202 and outside surfaces 204. A locking pin, generally designated 210, is provided and includes a body 212, whose cross section is regularly shaped corresponding to apertures 50, a handle 214 attached to the body 212 and of sufficient size to prevent pin 210 from falling through aperture 50, and a square portion 216 located on its bottommost end whose diagonal is less than or equal to the diameter of body 212 such that square portion 216 does not extend beyond the circumference of body 212.

To lock the towers, pin 210 is inserted into an aperture 50 of tread member 22 such that body 212 extends through top surface 26 and bottom surface 28 and substantially fills aperture 50 and such that square portion 216 extends into the channel 200 and square portion 216 is captured within U-shaped inside surface 202. Pin 210 can also be positioned such that a side of square portion 216 abuts an outside surface 204 of channel 200 as best seen in FIG. 8. Handle 214 prevents pin 210 from falling through the aperture 50 of tread member 22. Since the pull towers 150 are pivotally mounted to straightening apparatus 20, channel 200 will not have the same angular relationship to tread member 22 when pull towers 150 are at different angles with respect to tread member 22. Due to the regular shape of body 212, such as circular, as shown, pin 210 can be turned such that square portion 216 fits within U-shaped surface 202 of channel 200 or such that an entire side of square portion 216 abuts that outside surface 204 of channel 200.

The front pull tower 151 can be similarly locked by placing a pin 210 in an aperture 50 of tread member 22. Further, a removable cross tie 36 can be placed in the C-shaped track of tread member 22 such that locking pin 210 can extend through apertures 54 of tie 36 into channel 200 in a similar manner as explained with respect to the tram mounted pull towers 150.

To aid in anchoring the vehicle on the straightening apparatus 20 to prevent the vehicle from moving when it is subjected to the counter forces during the repair and straightening operation, bolsters 230 are provided, as best seen in FIG. 9. Bolsters 230 include a body 232 having a cross section of a regular shape corresponding to apertures 50, 52, or 54, and an abutting portion 234 having a contacting surface 231 of large area located on the uppermost portion of bolster 230. An L-shaped locking ring 236 having an oversized aperture 238 is positioned about bolster 230 such that locking ring 236 cants against the circular body 232 of bolster 230 and thus secures bolster 230 above tread 22 adjacent the vehicle frame 500. The length of the bolster should be sufficient such that bolster 230 passes through surfaces 26 and 28 and still allows abutting portion 234 to contact the frame 500 of the vehicle to be straightened.

After a vehicle is placed on straightening apparatus 20, bolsters 230 are installed by inserting the abutting portion 234 through aperture 50 in bottom surface 28 and pushing bolster 230 through top surface 26. Locking ring 236 is placed on bolster 230, and bolster 230 is raised to the desired height. At the desired height, the bolster 230 is dropped such that ring 236 cants and secures bolster 230. To remove bolster 230, bolster 230 is raised slightly, and ring 236 is then held to prevent it from canting, and bolster 230 is removed.

Figures 7, 10:
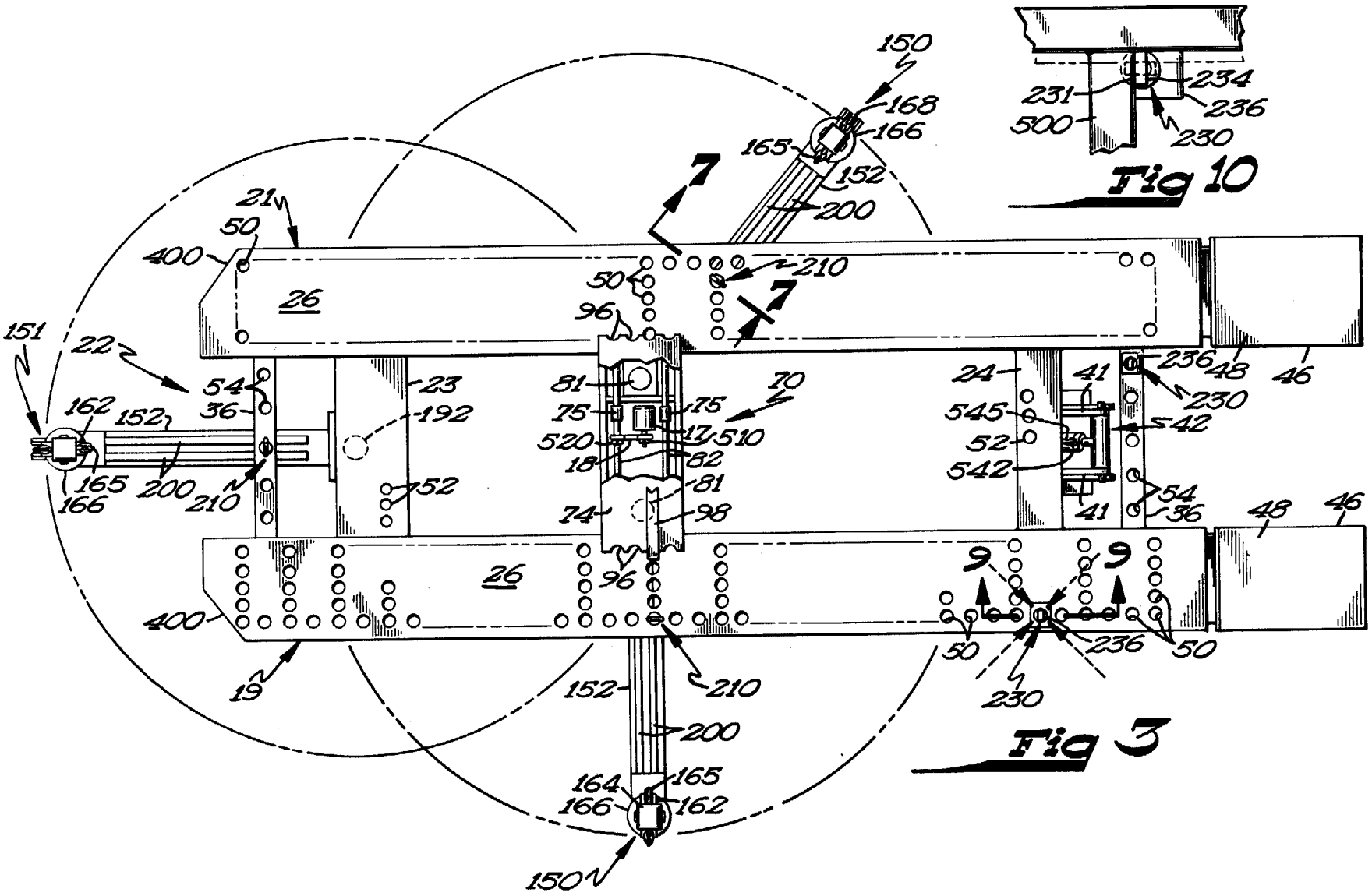
FIG. 10 is a top view of the sectional view shown in FIG. 9.

Due to the regular shape of the cross section of body 232, bolster 230 can be turned such that contacting surface 231 of abutting portion 234 entirely engages a frame member 500 of the vehicle to be straightened perpendicularly to the major component of the pulling force. If the direction of pull changes thus requiring change of the position of bolster 230, bolster 230 is lowered below the frame 500 of the vehicle to allow rotating of bolster 230 and then raised to contact a frame member 500 perpendicular to the original position, as shown in phantom in FIG. 10, or at any other desired angle.

Bolsters 230 can further be used for crosstying the vehicle to tread member 22 from any angle around bolster 230 without extending beyond the border of tread member 22. As is known in the prior art, methods to anchor the vehicle to the pulling apparatus are anchor chains fastened from the track members to the vehicle and anchor members which extend from portions other than the tread member that abut with portions of the vehicle. Such methods of anchoring are very time consuming, require a very complicated superstructure, extend beyond the boundaries of the tread member thus interfering with the normal operation of the apparatus, and are able to withstand a force only along one or two directions, the longitudinal or latitudinal directions. If the repair force does not lie exactly perpendicular to such directions, a force-concentration will result causing possible damage to the vehicle at the point of contact with the anchor member. Further, if the major force does not lie along either the longitudinal or latitudinal direction but rather along a diagonal, for example, the vehicle will twist within the apparatus.

The present invention solves the above-mentioned problems by providing bolster 230 which is able to be subjected to a counter force in any direction 360 degrees around bolsters 230 as is shown in FIG. 3. Abutting portion 234 of bolster 230 can always be positioned perpendicularly to the pulling force. Also, bolster 230 lies entirely within the borders of tread member 22, does not require any further superstructure for its attachment, and further can be positioned in any aperture of tread member 22 or in removable cross tie 36 placed in any desired position. Additionally, bolster 230 can be inserted or removed in a minimal amount of time without the use of tools.

OPERATION

In operation, the apparatus for repairing and straightening the body and the frame of a vehicle, according to the present invention, repairs vehicles having structural damage, such as damage from common automobile accidents. To place a vehicle on the present apparatus 20, first, safety leg 44 is pivoted horizontally adjacent to tread member 22 by moving extension 562. By operation of valve 543 hydraulic jack 542 is retracted causing lift scissors 42 to fold together and thus pivoting tread member 22 on support 38 to its angularly offset position. In its angularly offset position, top surface 26 of tread member 22 is flush with top surfaces 48 of floor members 46, as shown in phantom in FIG. 2, thus preventing a smooth incline for the vehicle.

A damaged vehicle can then be driven onto the apparatus 20 such that the tires of the vehicle are placed on the left and right tracks 19 and 21, respectively, of tread member 22. If the damage to the vehicle is extensive, the vehicle may have to be winched on the apparatus 20. This could be accomplished by anchoring a suitable winch, not shown, on front pull tower 151 and connecting the winch line to the vehicle.

After the vehicle is placed thereon, tread member 22 is then pivoted on support 38 to a horizontal position such that tread member 22 is parallel to the floor on which apparatus 20 is mounted, as shown in solid line in FIG. 2. This is accomplished by extending hydraulic jack 542 by operation of valve 543 to unfold lift scissors 42 thus raising tread member 22. With member 22 in its horizontal position, safety leg 44 can then be positioned in its vertical position. Thus, for example, if lift scissors 42 were to accidentally fold, safety leg 44 would prevent tread member 22 from pivoting on support 38 to its angularly offset position.

After a vehicle is positioned on tread member 22 and tread member 22 is in its horizontal position, the vehicle must be secured to straightening apparatus 20 such that pulling forces can be applied to the vehicle without having the vehicle move. In the preferred embodiment, bolsters 230 are placed in straightening apparatus 20 to secure a vehicle on tread member 22 to thereby anchor the vehicle to tread member 22 to prevent its movement thereon during the straightening and repairing operation and to receive the counter forces to which the vehicle is subjected during the pulling operation as hereinbefore discussed.

Bolsters 230 are positioned in apparatus 20 by pushing them into apertures 50 through both bottom surface 28 and top surface 26. Locking ring 236 is placed on bolster 230 such that bolster 230 extends through aperture 238. Due to its "L" shape, locking ring 236 cants on bolster 230 when bolster 230 moves vertically downward. Since it extends through apertures 50 formed in both top surface 26 and bottom surface 28, bolster 230 is prevented from moving in any direction in the place of tread member 22.

It can be appreciated that removable cross ties 36 can be positioned in the C-shaped track formed in tread member 22 such that bolsters 230 can also be placed in apertures 54 located therein. Thus, cross ties 36 are placed in a desired position beneath a brace, of the frame for example, such that a bolster 230 can be placed in an aperture 54 to abut the brace as shown in FIG. 3.

Bolsters 230 are positioned such that a portion of the vehicle abuts a large contacting surface 231 of abutting portions 234. Surface 231 of abutting portion 234 should be placed against a flat area of the vehicle frame 500 which should be substantially perpendicular to the repair force to be subjected to the vehicle. In such a position, the counter force placed on the vehicle frame 500 at surface 231 will be placed on a large area to prevent abutting portion 234 from damaging the frame 500 such as is possible if the contacting surface were smaller. Due to the large numbers of apertures 50 and apertures 54 of cross ties 36, bolster 230 can be placed in a variety of positions such that abutting portion 234 contacts the vehicle frame in the desired manner.

If it is desired to change the direction of the pulling force thus requiring bolsters 230 to be turned, bolsters 230 do not have to be removed entirely from tread member 22 of apparatus 20. Due to the regular shape of the cross section of body 232, shown as circular in the preferred embodiment, bolsters 230 can be rotated without removing them completely from the device. It is only necessary to raise bolster 230 a sufficient amount to uncant locking ring 236. Locking ring 236 is then held preventing it from canting on bolster 230. Bolster 230 is then lowered such that abutting portion 234 is below the vehicle frame. Bolster 230 can then be rotated to the desired position, raised to the desired height, and set to engage the vehicle to be repaired.

It can now be appreciated that bolsters 230 lie within the border of tread member 22 and thereby allow the free operation of pull towers 150 and 151 and tram 70. Further, bolsters 230 tie the vehicle to the tread member 22 and against a force from the pull towers directed from any direction, 360 degrees around the tread member 22. Additionally, bolsters 230 can be placed in, removed from, and/or rotated in tread member 22 in a minimal time, without the use of tools.

Other suitable methods of anchoring can be used or incorporated. For example, a chain or other fastening means can extend from the vehicle to tread member 22. Such fastening means could then hook into apertures 50 or could be wrapped around bolster 230 placed in tread member 22 that either does or does not abut the vehicle frame.

Next, tram 70 is positioned adjacent the damaged portion of the vehicle as follows. Locking member 98 is raised such that projections 102 are removed from apertures 50 in the right and left track members 19 and 21 of tread member 22. Actuated by switch 103, motor 17 can then drive shafts 82 by means of sprockets 510 and 520 and roller chain 18, thus causing sprockets 84 to mesh with chains 95 mounted on flange 32 of tread member 22 and causing rollers 83 to move along rails 85 thus moving tram 70 relative to tread member 22. Due to the greater spacing of tram top 74 and tram bottom 76 than the spacing of tread top surface 26 and bottom surface 28 the only portion of tram 70 that contacts tread member 22 is sprockets 84 and rollers 83.

Thus a minimal amount of sliding friction is created between tram 70 and tread member 22 causing less wear in the apparatus 20 and allowing the required horsepower of the motor for moving tram 70 to be reduced.

When tram 70 is in the desired position, locking member 98 is positioned such that circular projections 102 interfit with removed portion 96 of tram top 74 and extend into apertures 50. Thus tram 70 is securely held from moving longitudinally relative to tread member 22.

Tram 70 is able to move the full distance between cross members 23 and 24 and switches 104 are positioned to stop tram 70 when it abuts cross members 23 and 24. Thus tram 70 can be positioned in any desired location between cross members 23 and 24. If it is desired that tram 70 be able to be positioned in the space beyond cross members 23 and 24, tram 70 can be redesigned to meet the particular circumstances or cross members 23 and 24 can be located closer to the ends of track members 19 and 21.

In the preferred embodiment, cross members 23 and 24 are located such that pull towers 150 are able to pivot to a position directly in front of tread member 22 such that pulling members 150 are placed on opposite sides of and adjacent to pull tower 151 or directly in back of tread member 22 opposite pull tower 151 when tram 70 abuts cross members 24 and 23, respectively. Further, notches 400 are shown in the front outside corners of tracks 19 and 21 such that cross member 23 can be positioned further from the front of apparatus 20 and still allow pull towers 150 to pivot to the front of apparatus 20. That is, when tram 70 abuts cross members 23, the notches 400 are within the radius of pull towers 150 about pivot 81 in the preferred embodiment. Therefore, pull towers 150 are able to pass the corners of track members 19 and 21 such that they can be placed on opposite sides of and adjacent to pull tower 151. Further when tram 70 abuts cross member 24, pull towers 150 are able to pivot around the rear corners of track members 19 and 21 such that they are placed directly in back of tread member 22. In such a position, towers 150 are directly opposite pull tower 151 located in front of tread member 22.

It can now be appreciated that towers 150 can be located about the entire 360 degree periphery of the vehicle wished to be repaired. Further, with the simple design and flexibility of apparatus 20, towers 150 and 151 can further be placed at any desired angle around the entire 360 degree periphery. Therefore, apparatus 20 can be used to repair and straighten damage caused from a force directed from any angle around the entire 360 degree periphery of the vehicle as will be further explained hereinafter.

Pull towers 150 can then be pivoted about pivot members 81 and pull tower 151 pivoted about stationary pivot member 192 such that chain 165 can be located along the force vector which caused the damage to the vehicle. When pull towers 150 and 151 are located in the desired position, towers 150 and 151 are securely locked to prevent them from moving. Locking pins 210 are inserted in apertures 50 of tread member 22 such that square portion 216 contacts channel 200 of connector 152 as previously explained. Handle 214 allows the operator to grasp pin 210 to place it within aperture 50, but also prevents pin 210 from falling through aperture 50. Due to the regular shaped cross section of body 212, such as circular as shown in the preferred embodiment, pin 210 can be rotated such that square portion 216 can be placed in any angular position relative to tread member 22. Thus pin 210 can be positioned such that square portion 216 is captured within U-shaped inside surface 202 of channel 200 or a side of square portion 216 abuts an outside surface 204 of channel 200. It should be noted, if square portion 216 of pin 210 abuts an outside surface 204 of channel 200, pin 210 should be placed such that it is located in the path of movement of pull tower 150 as it exerts a pulling force on a vehicle placed on apparatus 20. Thus towers 150 are locked to prevent pivoting about pivot members 81 in at least one direction.

It can now be appreciated that if pull tower 151 is located such that locking pins 210 placed in apertures 50 at tread member 22 do not contact channel 200 of pull tower 151, a removable cross tie 36 can be positioned in tread member 22 such that a locking pin can be placed in an aperture 54 formed therein, as best seen in FIG. 3.

Chains 165 are then fastened to the damaged portion of the vehicle body to be repaired. This can be done in a number of conventional ways such as by the use of hooks, welding on metal portions, or other techniques. Other forms of fastening chains 165 to the vehicle can be used as is known by one skilled in the art.

Collar 172 is then positioned on vertical portion 154 of pull tower 150. First lever arm 182 is raised to an upward position, as shown in phantom in FIG. 4, such that cam portion 180 disengages the sides of vertical portion 154. Collar 172 can then be raised on, lowered on, and/or pivoted about vertical portion 154. Collar 172 is then positioned such that chain 165 is directed by pulley 174 towards the damaged portion of the vehicle along the same force vector that created the damage to the vehicle. When collar 172 is placed in the desired position, lever arm 182 is lowered such that cam portion 180 engages the side of vertical portion 154 thus securing collar 172 on vertical portion 154. It should be noted that if collar 172 is pivoted about vertical 154 through a large angle, it may be necessary to change the direction of pulley 162 and chain lock collar 166 by pivoting ram sleeve 158 within vertical portion 154 and by rotating collar 166 about vertical portion 154, respectively.

Assuming ram sleeve 158 is in its lowered position, chain 165 is pulled taut over pulley 162 and placed in chain lock member 166. A link of chain 165 is positioned with slot 168 of chain locking member 166 thereby preventing vertical movement of chain 165.

Valves 188 are then adjusted on pull towers 150 and 151 to the desired flow rate such that ram sleeve 158 of each tower will elongate proportionally to each other. Control box 194 is then contacted to cause hydraulic unit 80 to pump oil to cylinders 184 via hoses 190 and 186. Cylinder 184 thus extends, raising ram sleeve 158, and pulley 162 is caused to press against chain 165 and thus create a pulling force on the portion of the vehicle body to which chain 165 is connected. Since chain 165 is connected to vertical portion 154 which is stationary with respect to ram sleeve 158, the chain 165 will move twice as far as the distance traveled by ram sleeve 158.

Ram sleeves 158 will move at a rate dependent upon the setting of valve 188. For example, one tower could travel three inches, another five inches, and the other ten inches during the same time interval. The rate at which ram sleeve 158 moves is dependent upon the type and amount of damage. Therefore, the settings of valve 188 on each of towers 150 and 151 are determined by the discretion of the operator based upon his discretion as to the ram sleeve 158 movement required for the type of damage to the vehicle. Either one, two, or three towers 150 and 151 can be used depending upon the particular damage on the vehicle to be repaired as will be further illustrated hereinafter.

It should be noted that, as cylinder 184 extends, a counter force is transferred to pull towers 150 and 151. As discussed above, this counter force is carried back to pivot members 81 and 192. Due to nylon bushing 602 of the preferred embodiment forming a ring sleeve type bearing, clamps 156 are able to withstand a force from any direction. Therefore, the pulling force exerted by pull towers can be exerted in any direction, even in a direction away from tread member 22. For example, a pulling force can be exerted on a vehicle not anchored to tread member 22 of the associated pull towers 150 and 151 of a first apparatus 22 but rather anchored to a tread member of second apparatus placed adjacent to the first apparatus, or anchored in a stationary position to the floor surface ajacent to the apparatus 22 in any manner.

Since pivot member 81 is mounted on tram 70, tram 70 is subjected to a torque causing it to twist in tread member 22. The twisting first acts on shaft 82 but due to its spring mounting, shaft 82 deflects vertically allowing tram top 74 to contact top surface 26 and/or tram bottom 76 to contact bottom surface 28. Thus shafts 82 are subjected only to the initial force while the carrier member 72 receives the major counter forces of the pulling force created by pull towers 150 pivotally mounted on tram 70.

During operation, pull towers 150 and 151 may have to be repositioned and/or the flow rate of valves 188 may have to be changed such that the repair force applied to the damaged portion is in a direction parallel to the force which caused the damage. Therefor, the direction may change depending upon the type and extent of damage to the vehicle. Also, bolster 230 may have to be rotated due to a change in the major force component or due to the fact that the frame elements are being straightened to their original positions.

After the repairing and straightening operations have been completed, chains 165 are removed from the vehicle. The vehicle can then be removed from apparatus 20 by removing bolsters 230 and/or removing securing chains. At this time, tread member 22 can be pivoted to its angularly offset position by raising safety leg 44 and folding lift scissors 42. The repaired vehicle can then be removed for finishing and apparatus 20 is ready to receive another vehicle to be repaired.

To better illustrate the advantages of the present invention in its preferred form, diagrammatic figures are shown depicting the location of the pulling means 150 and 151 when repairing vehicles having damage caused in common traffic accidents. FIGS. 11-15 show such diagrammatic views of the preferred form and show the various functional features of the present invention in its preferred form without resorting to the structural detail as previously outlined. For the sake of example, it is assumed that all vehicles depicted in the figures are facing forward such that the front of the vehicle is adjacent to pull tower 151.

Figure 11:
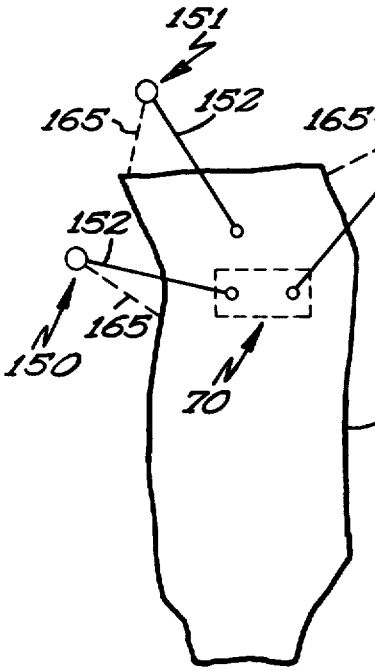
FIGS. 11–15 show diagrammatic views of example operations of the apparatus of FIG. 1.
Figure 12:
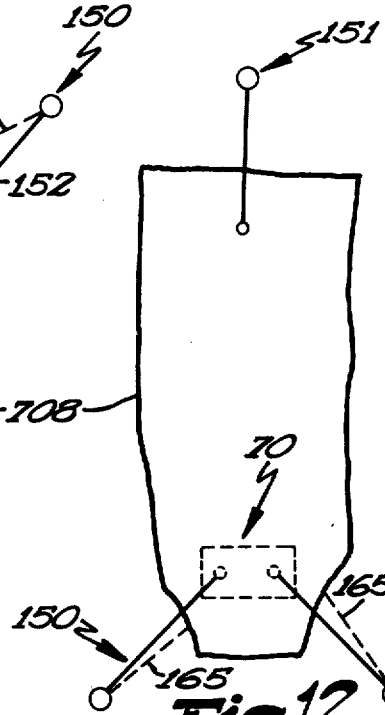

In FIGS. 11 and 12, a vehicle having front and rear damage is depicted. The front of the vehicle is pushed rearward and to the left side while the rear of the vehicle has a large amount of damage on the right side and a lesser amount of damage on the left side. Such damage could be caused by a vehicle being angularly hit on the rear right side and being pushed into objects located to the front and the side of the vehicle. To repair the vehicle, first, tram 70 is quickly and efficiently moved adjacent pull tower 151 by the mechanism, as previously explained. Towers 150 are then pivoted forwardly on tram 70 to angularly offset positions such that the left pull tower pulls outwardly on indentation in the left fender and right tower pulls outwardly and longitudinally the right corner of the vehicle. Tower 151 is positioned to pull longitudinally and to the right of the left corner. Thus, the front end can be straightened to the correct position by the simultaneous operation of pull towers 150 and 151, and each of towers 150 and 151 would place a pulling force on the vehicle corresponding to the rate of movement selected by the operator, as previously explained. The corrected position of the front of the vehicle is depicted in FIG. 12.

At this time, pull towers 150 can be disconnected and moved to the rear of the vehicle. This is accomplished by moving tram 70 adjacent to cross member 24, as was previously explained, and then pivoting towers 150 rearwardly on tram 70 to the positions shown in FIG. 12. In such a position, towers 150 are located such that they are able to exert a pulling force in a direction parallel to the force that caused the damage and therefore apparatus 20 can easily straighten and repair the remaining damage shown in FIG. 12 in a similar manner, as previously explained.

It can now be appreciated that due to the pivotal mounting of towers 150 and 151 and the movable tram 70, the vehicle can be repaired around the entire 360 degree periphery without having to turn the vehicle as is commonly required by conventional straightening apparatus. Further the pull towers can be rapidly and efficiently positioned at any angle with respect to the vehicle in a simple manner by the mechanism of the present invention, as previously explained.

Figure 13:
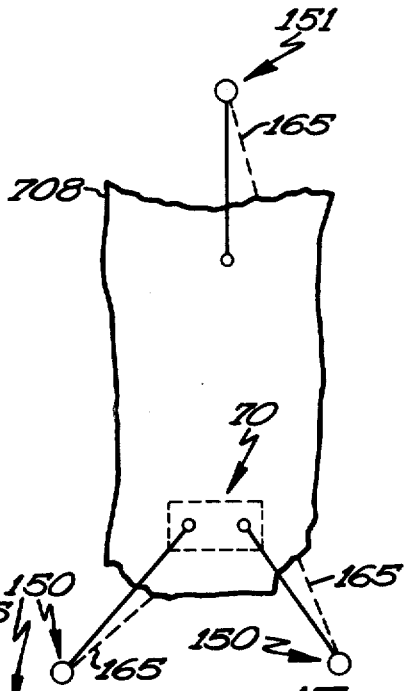

FIG. 13 shows a vehicle having front and rear damage such as may be caused by a multiple car pileup. Tram 70 can be first located adjacent the rear of the vehicle, and pull towers 150 positioned to pull the indentations from the rear of the vehicle. Pull tower 151 may then be positioned to pull out the damage in the front of the vehicle. The operator then adjusts the rate of movement of towers 150 and 151 and activates switch 194, thus causing the three pull towers, 150 and 151 to each exert a pulling force to the vehicle simultaneously, as was previously explained. Thus, the damage to the front and rear of the vehicle having this type of damage can be repaired simultaneously. Previously, to repair such a vehicle would generally require repairing first one end, turning the vehicle such that the other end is adjacent the pulling means, and repairing the other end of the vehicle or would require a great deal of time and effort to move pulling towers and lock them in the desired position.

Figure 14:
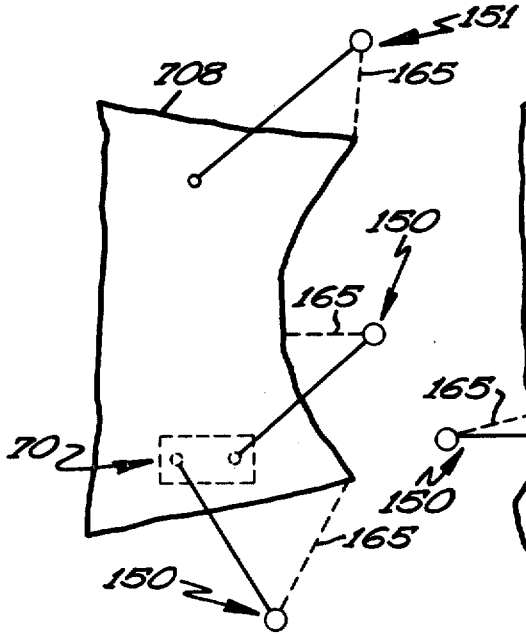

FIG. 14 shows a vehicle having a large indentation formed in the right side thereof. Such damage could be caused by another vehicle hitting the damaged vehicle broadside. To repair the damaged vehicle, first, tram 70 may be moved adjacent the rear, as previously explained, and pull towers pivoted on tram 70 such that, in the position shown, the first tower 150 can pull the right rear corner, and the second tower 150 can pull the center of the indentation. Tower 151 may then be arranged to pull the right front fender. The vehicle can then be repaired in a simple operation by the simultaneous operation of all three pull towers, 150 and 151, moving at the desired rate as previously explained. In the prior art, the vehicle may have to be turned several times, each time only a small portion of the damage would have been removed.

Figure 15:
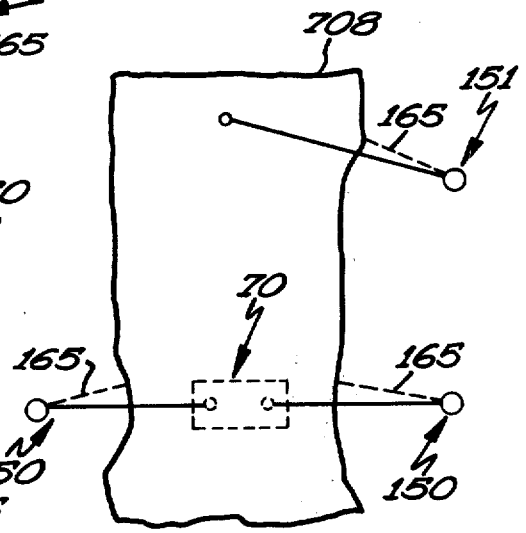

FIG. 15 shows another broadside collision of lesser force where the vehicle also sustained damage on the opposite sides such as that caused from the vehicle being pushed into a road sign. Such damage could be repaired by placing pull towers 150 on opposing sides of the vehicle such that damage could be pulled out from both sides simultaneously while tower 151, pivoted to the right side, helped the right pull tower 150 remove damage to the right side. Therefore the vehicle can be repaired in a single, simple manner by the simultaneous operation of pull towers 150 and 151, according to the rates desired by the operator.

It can now be appreciated that the preferred embodiment of the present invention, as shown by apparatus disclosed, is very efficient, flexible, and of simple design. Apparatus 20 can repair damage around the entire 360 degree periphery of a damaged vehicle due to the pivotable pull towers 150 on movable tram 70 and pull tower 151. Further, the direction of the repair force can be applied in a direction parallel to the direction of the force that caused the damage by the use of the pulley 174 carried by collar 172 which is slidable along and pivotable about vertical portion 154 of pull towers 150 and 151 and in conjunction with the pivotable mounting of pull towers 150 and 151 on apparatus 20 and the remainder of the overall design, including tram 70. Therefore, apparatus 20 is able to repair a variety of types of damage to vehicles from an unlimited number of directions. Further, due to the flexibility of apparatus 20, the repair force can be applied at any desired angle around the entire 360 degree periphery of the damaged vehicle. Also, due to the design of the present invention, efficient use is made of the apparatus and its materials.

Now that the basic teachings of the present invention have been explained, many extensions and variations will be obvious to one having ordinary skill in the art. For example, pull towers could be removed or more pull towers could be added to pivot about the same point or adjacent points.

Further additional trams could be added such that for example, one tram could be placed adjacent the front of the vehicle and one could be placed adjacent the rear of the vehicle, or any position therebetween.

Additionally one pull tower could be removed from the movable tram or additional ones added so that a plurality of pulling means could be placed adjacent the damaged portion.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

I claim:

1. Apparatus for repairing and straightening the body and frame of a wheeled vehicle comprising, in combination: a tread member having a first end and a second end and having a top surface and a bottom surface and including a right track member and a left track member, each of the right and left track members having a top surface formed thereon to allow support of the vehicle thereon; means for allowing placement of a vehicle upon the tread member; at least one means for applying a force to the vehicle; a tram body; means for movably mounting the tram body between the right and left track members including means for moving the tram body along the right and left track members; and means for pivotally interconnecting the force applying means to the tram body to allow positioning the force applying means on the outside of the tread member to thereby allow the tram body to be positioned at any position between the first end and the second end of the tread member and to allow the force applying means to be positioned at any desired angle around the thread member such that the repairing and straightening force can be applied at any angle around the entire 360 degree periphery of the vehicle; wherein the movably mounting means comprises, in combination, at least one rotatable shaft carried by the tram body having a first end which engages a portion of the right track member and a second end which engages a portion of the left track member; wherein the moving means comprises, in combination, means for rotating the shaft and means operatively connected to the shaft for converting the rotation of the shaft to cause movement of the tram body along the right and left track members; and wherein the tram body further comprises, in combination: means for resiliently mounting the rotatable shaft in the tram body; and means for receiving the counterforce of the force exerted on the damaged vehicle by the force applying means pivotally interconnected to the tram body wherein under a load condition, the shaft deflects due to the resiliently mounting means such that the shaft is subjected only to the initial force while the means for receiving the counterforce receives the major counterforce.

2. The apparatus of claim 1 wherein the movably mounting means further comprises, in combination: a flexible connector for allowing the shaft to flex adjacent its center.

3. The apparatus of claim 1 wherein the converting means comprises, in combination: at least one stationary, elongated gear member attached to the apparatus for repairing and straightening, and wherein the shaft includes at least one sprocket which meshes with the stationary, elongated gear member.

4. The apparatus of claim 3 wherein the stationary, elongated gear member comprises chain links fastened to the apparatus for repairing and straightening.

5. The apparatus of claim 3 wherein the apparatus further comprises, in combination: means for reducing the amount of weight carried by the sprocket.

6. The apparatus of claim 5 wherein the reducing means comprises, in combination: a roller mounted on the shaft adjacent to the sprocket.

7. The apparatus of claim 6 wherein the apparatus further comprises, in combination: a rail portion formed adjacent to the stationary gear member upon which the roller rides.

8. The apparatus of claim 1 wherein the converting means comprises, in combination: a first stationary, elongated gear member located on the right track member; a second stationary, elongated gear member located on the left track member parallel to the first gear member; a first sprocket member located on the first end of the shaft and engaging the first gear member; and a second sprocket located on the second end of the shaft and engaging the second gear member thereby forming a rack and pinion gear arrangement such that as the rotable shaft is rotated, the first and second sprockets mesh with the first and second stationary gear members.

9. The apparatus of claim 1 wherein the means for receiving the counterforce of the force exerted on the damaged vehicle by the force applying means comprises, in combination: a tram top attached to the tram body, with the tram top extending over the top surface of the tread member; and a tram bottom attached to the tram body, with the tram bottom extending below the bottom surface of the tread member such that when a counterforce is subjected to the tram body, the tram top contacts the tread top surface and the tram bottom contacts the tread bottom surface.

10. The apparatus of claim 1 wherein the apparatus comprises: a first force applying means and a second force applying means and wherein the first force applying means is pivotally interconnected to the tram body adjacent to the right track member and the second force applying means is pivotally interconnected to the tram body adjacent to the left track member such that the first and second force applying means are located on opposite sides of the apparatus for repairing and straightening.

11. The apparatus of claim 10 wherein the apparatus further comprises: a third force applying means; and means for pivotally interconnecting the third force applying means about the first end and front sides of the tread members of the apparatus for repairing and straightening.

12. The apparatus of claim 1 wherein the force applying means includes a hydraulic cylinder; wherein the apparatus further comprises a hydraulic unit for supplying hydraulic fluid to the hydraulic cylinder of the force applying means; and wherein the means for rotating the shaft and the hydraulic unit are carried by the tram body.

13. Apparatus for repairing and straightening the body and frame of a wheeled vehicle comprising, in combination: a tread member having a first end and a second end and having a top surface and a bottom surface and including a right track member and a left track member, each of the right and left track members having a top surface formed thereon to allow support of the vehicle thereon; means for allowing placement of a vehicle upon the tread member; at least one means for applying a force to the vehicle; a tram body; means for movably mounting the tram body between the right and left track members including means for moving the tram body along the right and left track members; and means for pivotally interconnecting the force applying means to the tram body to allow positioning the force applying means on the outside of the tread member to thereby allow the tram body to be positioned at any position between the first end and the second end of the tread member and to allow the force applying means to be positioned at any desired angle around the tread member such that the repairing and straightening force can be applied at any angle around the entire 360 degree periphery of the vehicle; wherein the pivotally interconnecting means comprises, in combination: a small cylindrical pivot member mounted to the tram body; a connector arm extending from the force applying means to a point adjacent to the pivot member; means for pivotally mounting the connector arm to the pivot member and for allowing the counterforce applied to the connector arm by the force applying means to be conveyed to the pivot member from any direction comprising: a clamp member pivotably connected about the pivot member, and a ring-sleeve type bearing located between the clamp member and the pivot member.

14. The apparatus of claim 13 wherein the pivotally interconnecting means further comprises, in combination: means for positioning and leveling the connector arm on the pivot member comprising, in combination: a thrust plate; and adjustment screws abutting the thrust plate, wherein the means for pivotally mounting the connector arm to the pivot member and for allowing the counterforce applied to the connector arm by the force applying means to be conveyed to the pivot member from any direction operatively rests on the thrust plate.

15. The apparatus of claim 14 wherein the pivotally interconnecting means further comprises, in combination: means for reducing the friction between the thrust plate and the means for pivotally mounting the connector arm to the pivot member and for allowing the counterforce applied to the connector arm by the force applying means to be conveyed to the pivot member from any direction.

16. Apparatus for repairing and straightening the body and frame of a wheeled vehicle comprising, in combination: a tread member having a first end and a second end and having a top surface and a bottom surface and including a right track member and a left track member, each of the right and left track members having a top surface formed thereon to allow support of the vehicle thereon; means for allowing placement of a vehicle upon the tread member; at least one means for applying a force to the vehicle; a tram body; means for movably mounting the tram body between the right and left track members including means for moving the tram body along the right and left track members; and means for pivotally interconnecting the force applying means to the tram body to allow positioning the force applying means on the outside of the tread member to thereby allow the tram body to be positioned at any position between the first end and the second end of the tread member and to allow the force applying means to be positioned at any desired angle around the tread member such that the repairing and straightening force can be applied at any angle around the entire 360 degree periphery of the vehicle; and with the apparatus further comprising, in combination: a plurality of apertures passing vertically through the top surface of the right and left track members of the tread member; and means for locking the tram body in a stationary position with respect to the track members comprising, in combination: an elongated member and projections located adjacent the ends of the elongated member, with the projections having a shape able to extend into the apertures, and removed portions formed on the tram body wherein the projections extend into the removed portions and into the apertures to securely hold the tram body in a stationary position.

17. Tram for use in an apparatus for repairing and straightening the body and frame of a wheeled vehicle comprising, in combination: a tram body; means for movably mounting the tram body to the apparatus for repairing and straightening; at least one means for applying a force to the vehicle; and means for pivotally interconnecting the force applying means to the tram body; wherein the movably mounting means comprises, in combination: at least one shaft carried by the tram body having a first end and a second end and with the shaft engaging a portion of the apparatus for repairing and straightening; means for rotating the shaft; at least one stationary elongated gear member attached to the apparatus for repairing and straightening; and at least one sprocket carried by the shaft which meshes with the stationary, elongated member; wherein the apparatus for repairing and straightening includes a tread member having a top surface and a bottom surface and including a right track member and a left track member; and wherein the movably mounting means comprises: means for movably mounting the tram body between the right and left track members of the apparatus for repairing and straightening: and wherein the tram body further comprises, in combination: means for resiliently mounting the rotatable shaft in the tram body; and means for receiving the counterforce of the force exerted on the damaged vehicle by the force applying means pivotally interconnected to the tram body wherein under a load condition, the shaft deflects due to the resiliently mounting means such that the shaft is subjected only to the initial force while the means for receiving the counterforce receives the major counterforce.

18. The tram of claim 17 wherein the means for receiving the counterforce of the force exerted on the damaged vehicle by the force applying means comprises, in combination: a tram top attached to the tram body, with the tram top extending over the top surface of the tread member; and a tram bottom attached to the tram body, with the tram bottom extending below the bottom surface of the tread member such that when a counterforce is subjected to the tram body, the tram top contacts the tread top surface and the tram bottom contacts the tread bottom surface.

19. Apparatus for repairing and straightening the body and frame of a wheeled vehicle comprising, in combination: a tread member having a first end and a second end and having a top surface and a bottom surface and including a right track member and a left track member; means for allowing placement of the vehicle upon the tread member to be supported thereby; at least one means for applying a force to the vehicle; a tram body; means for movably mounting the tram body between the right and left track members; and means for pivotally interconnecting the force applying means to the tram body to allow positioning the force applying means on the outside of the tread member to thereby allow the tram body to be positioned at any position between the first end and the second end of the tread member and to allow the force applying means to be positioned at any desired angle around the tread member such that the repairing and straightening force can be applied at any angle around the entire 360 degree periphery of the vehicle; wherein the movably mounting means comprises, in combination: at least one shaft carried by the tram body and having a first end which engages a portion of the right track and a second end which engages a portion of the left track; and wherein the tram body further comprises, in combination: means for resiliently mounting the shaft in the tram body; and means for receiving the counterforce of the force exerted on the damaged vehicle by the force applying means pivotally interconnected to the tram body wherein, under a load condition, the shaft deflects due to the resiliently mounting means such that the shaft is subjected only to the initial force while the means for receiving the counterforce receives the major counterforce.

20. The apparatus of claim 19 wherein the means for receiving the counterforce of the force exerted on the damaged vehicle by the force applying means comprises, in combination: a tram top attached to the tram body, with the tram top extending over the top surface of the tread member; and a tram bottom attached to the tram body, with the tram bottom extending below the bottom surface of the tread member such that when a counterforce is subjected to the tram body, the tram top contacts the tread top surface and the tram bottom contacts the tread bottom surface.

21. The apparatus of claim 19 wherein the movably mounting means includes means for moving the tram body along and between the right and left track members.

22. The apparatus of claim 21 wherein the moving means comprises, in combination: means for rotating the shaft; and means operatively connected to the shaft for converting the rotation of the shaft to cause movement of the tram body along and between the right and left track members.

23. The apparatus of claim 22 wherein the converting means comprises, in combination: at least one stationary, elongated gear member attached to the apparatus for repairing and straightening, and wherein the shaft includes at least one sprocket which meshes with the stationary, elongated gear member.

24. The apparatus of claim 23 wherein the stationary, elongated gear member comprises chain links fastened to the apparatus for repairing and straightening.

25. The apparatus of claim 19 wherein the pivotally interconnecting means comprises, in combination: a small cylindrical pivot member mounted to the tram body; a connector arm extending from the force applying means to a point adjacent the pivot member; means for pivotally mounting the connector arm to the pivot member and for allowing the counterforce applied to the connector arm by the force applying means to be conveyed to the pivot member from any direction comprising, in combination; a clamp member pivotably connected about the pivot member; and a ring-sleeve type bearing located between the clamp member and the pivot member.

26. The apparatus of claim 25 wherein the pivotally interconnecting means further comprises, in combination: means for positioning and leveling the connector arm on the pivot member, comprising, in combination: a thrust plate; and adjustment screws abutting the thrust plate, wherein the means for pivotally mounting the connector arm to the pivot member and for allowing the counterforce applied to the connector arm by the force applying means to be conveyed to the pivot member from any direction operatively rests on the thrust plate.

27. The apparatus of claim 19 further comprising, in combination: a plurality of apertures passing vertically through the top surface of the tread member; and means for locking the tram body in a stationary position with respect to the tread member comprising, in combination: an elongated member, and projections located adjacent the ends of the elongated member, with the projections having a shape able to extend into the apertures, and removed portions formed on the tram body wherein the projections extend into the removed portions and into the apertures to securely hold the tram body in a stationary position.

28. Apparatus for locking a tram body in a stationary position within an apparatus for repairing and straightening the body and frame of a wheeled vehicle including a tread member including a right track member and a left track member, with each of the right and left track members having a top surface, means for allowing placement of a vehicle upon the tread member to be supported thereby, and means for movably mounting the tram body in the apparatus for repairing and straightening, comprising, in combination: a plurality of apertures having a shape passing vertically through the top surface of the right and left track members of the tread member; removed portions formed on the tram body; first and second projections having a shape able to extend into the apertures; an elongated member with the first and second projections being located on opposite ends of the elongated member wherein the elongated member is located parallel to the tram body and the projections extend the removed portions and into the apertures to securely hold the tram body in a stationary position.

29. The apparatus of claim 28 wherein the shape of the projection corresponds to the shape of the apertures.

30. The apparatus of claim 29 wherein the projection has a regular shape.

31. The apparatus of claim 28 wherein the apparatus for repairing and straightening further includes at least one means for applying a force to the vehicle; and means for pivotally interconnecting the force applying means to the tram body to allow positioning the force applying means on the outside of the tread member.

32. The apparatus of claim 28 wherein the movably mounting means includes means for moving the tram body.

33. Tram for use in an apparatus for repairing and straightening the body and frame of a wheeled vehicle comprising, in combination: a tram body; means for movably mounting the tram body to the apparatus for repairing and straightening comprising, in combination: at least one shaft carried by the tram body having a first end and a second end and with the shaft engaging a portion of the apparatus for repairing and straightening; at least one means for applying a force to the vehicle; means for pivotally interconnecting the force applying means to the tram body; means for resiliently mounting the shaft in the tram body; and means for receiving the counterforce of the force exerted on the damaged vehicle by the force applying means pivotally interconnected to the tram body wherein under a load condition, the shaft deflects due to the resiliently mounting means such that the shaft is to the initial force while the means for counterforce receives the major counterforce.

34. The tram of claim 33 wherein the apparatus for repairing and straightening includes a tread member having a top surface and a bottom surface, and wherein the means for receiving the counterforce of the force exerted on the damaged vehicle by the force applying means comprises, in combination: a tram top attached to the tram body, with the tram top extending over the top surface of the tread member; and a tram bottom attached to the tram body, with the tram bottom extending below the bottom surface of the tread member such that when a counterforce is subjected to the tram body, the tram top contacts the tread top surface and the tram bottom contacts the tread bottom surface.

35. The tram of claim 33 further including a flexible connector for allowing the shaft to flex adjacent its center.

36. The tram of claim 33 wherein the movably mounting means includes means for moving the tram body within the apparatus for repairing and straightening.

37. The tram of claim 36 wherein the moving means comprises, in combination: means for rotating the shaft; and means operatively connected to the shaft for converting the rotation of the shaft to cause movement of the tram body within the apparatus for repairing and straightening.

38. The tram of claim 37 wherein the converting means comprises, in combination: at least one stationary, elongated gear member attached to the apparatus for repairing and straightening, and wherein the shaft includes at least one sprocket which meshes with the stationary, elongated gear member.

39. Apparatus for repairing and straightening the body and frame of a wheeled vehicle comprising, in combination: a tread member, arranged for allowing support of the vehicle thereon, with the tread member having a first end and a second end and having a right track member and a left track member spaced from the right track member, with the right and left track members having a top surface and a bottom surface and having a first flange; a body member; means for movably mounting the body member to the first flanges of the right and left track members in the manner to allow the body member to be positioned at substantially any position between the first end and the second end of the tread member, with the body member arranged to accept counterforce from repairing and straightening the body and frame of the vehicle; and means for receiving the counterforce exerted on the body member wherein, under load condition, the movably mounting means and the first flanges of the right and left track members are subjected only to the initial force while the means for receiving the counterforce receives the major counterforce; and wherein, under load condition, the means for receiving the counterforce is supported by and contacts at least one of the top surface and the bottom surface of the right and the left track members.

40. The apparatus of claim 39 wherein, under a no load condition, the means for receiving the counterforce is spaced from the top surface and the bottom surface of the right and the left track members to reduce the sliding friction to a minimal amount.

41. The apparatus of claim 39 further comprising, in combination: at least one means for applying force to the vehicle; and means for interconnecting the force applying means to the body member to allow positioning the force applying means on the outside of the tread member.

42. The apparatus of claim 41 wherein the interconnecting means comprises means for pivotally interconnecting the force applying means to the body member.

43. The apparatus of claim 39 wherein the top surface of the right and left track members are arranged to support the vehicle.

44. The apparatus of claim 39 wherein the first flanges of the right and left track members are formed on the inside of the right and left track members, the body member is located between the right and left track members, and the movably mounting means movably mounts the body member between the right and left track members.

45. The apparatus of claim 44 wherein the first flange is formed on the track bottom surface and wherein the right and left track members further includes a second inside flange formed on the track top surface such that the first and second flanges form a C-shape track on the inside surface of each of the right and left track members, and wherein the movably mounting means comprises, in combination: at least one shaft carried by the body member and having a first end which engages the first flange of the right track member and a second end which engages the first flange of the left track member.

46. The apparatus of claim 45 wherein the means for receiving the counterforce includes means for resiliently mounting the shaft in the body member such that, under load condition, the shaft deflects due to the resiliently mounting means.

47. The apparatus of claim 39 wherein the movably mounting means comprises, in combination: at least one shaft carried by the body member and having a first end which engages the first flange of the right track member and a second end which engages the first flange of the left track member.

48. The apparatus of claim 47 wherein the means for receiving the counterforce includes means for resiliently mounting the shaft in the body member such that, under a load condition, the shaft deflects due to the resiliently mounting means.

49. The apparatus of claim 39 wherein the counterforce receiving means comprises, in combination: a top attached to the body member, with the top extending over the top surface of the right and left track members; and a bottom attached to the body member, with the bottom extending below the bottom surface of the right and left track members such that under load condition, the top contacts at least one of the top surfaces of the right and the left track members and the bottom contacts at least one of the bottom surfaces of the right and the left track members.

50. The apparatus of claim 49 wherein under no load condition, the top attached to the body member is vertically spaced above the top surfaces of the right and left track members and the bottom attached to the body member is vertically spaced below the bottom surfaces of the right and left track members such that only the movably mounting means contacts the right and left track members to reduce the sliding friction to a minimal amount.

51. The apparatus of claim 44 wherein the movably mounting means includes means for moving the body member along and between the right and left track members.

52. The apparatus of claim 51 wherein the movably mounting means comprises, in combination: at least one shaft carried by the body member and having a first end which engages the first flange of the right track member and a second end which engages the first flange of the left track member.

53. The apparatus of claim 52 wherein the moving means comprises, in combination: means for rotating the shaft; and means operatively connected to the shaft for converting the rotation of the shaft to cause movement of the body member along and between the right and left track members.

54. The apparatus of claim 53 wherein the converting means comprises, in combination: a first stationary, elongated gear member located on the first flange on the right track member; a second stationary, elongated gear member located on the first flange of the left track member parallel to the first gear member; and wherein the body member further includes: a first sprocket located on the first end of the shaft and engaging the first gear member; and a second sprocket located on the second end of the shaft and engaging the second gear member to from a rack and pinion gear arrangement such that as the rotable shaft is rotated, the first and second sprockets mesh with the first and second stationary gear members thereby moving the tram along and between the track members.

55. The apparatus of claim 54 wherein the stationary, elongated gear members comprise chain links fastened to the flanges of the right and left track members.

56. The apparatus of claim 42 wherein the pivotally interconnecting means comprises, in combination: a small cylindrical pivot member mounted to the body member; a connector arm extending from the force applying means to a point adjacent to the pivot member; means for pivotally mounting the connector arm to the pivot member and for allowing the counterforce applied to the connector arm by the force applying means to be conveyed to the pivot member from any direction comprising, in combination: a clamp member pivotally connected about the pivot member, and a ring sleeve type bearing located between the clamp member and the pivot member.

* * * * *